United States Patent [19]

Latchum, Jr.

[11] Patent Number: 4,567,340

[45] Date of Patent: Jan. 28, 1986

[54] APPARATUS AND METHOD FOR DRYING SOLID MATERIALS

[75] Inventor: John W. Latchum, Jr., Bartlesville, Okla.

[73] Assignee: Phillips Petroleum Company, Bartlesville, Okla.

[21] Appl. No.: 690,084

[22] Filed: Jan. 9, 1985

[51] Int. Cl.[4] ..... H05B 6/68; H05B 6/60

[52] U.S. Cl. ..... 219/10.41; 219/10.77; 219/10.81; 219/10.55 A; 219/10.55 B; 219/10.55 M; 34/1; 34/4

[58] Field of Search ..... 219/10.55 A, 10.55 R, 219/10.55 M, 10.55 B, 10.81, 10.41, 10.69, 10.77, 10.75; 34/1, 4, 43, 48, 55

[56] References Cited

U.S. PATENT DOCUMENTS

| | | | |
|---|---|---|---|
| 2,231,457 | 2/1941 | Stephen | 219/10.81 |
| 2,404,474 | 7/1946 | Collins | 73/15 |
| 2,432,934 | 12/1947 | Rasor | 196/52 |
| 2,483,623 | 10/1949 | Clayton | 219/47 |
| 2,542,028 | 2/1951 | Hodge | 202/121 |
| 3,273,629 | 9/1966 | Sargeant | 159/3 |
| 3,449,213 | 6/1969 | Knapp | 201/19 |
| 3,545,093 | 12/1970 | Forster | 34/1 |
| 3,552,031 | 1/1971 | Evans | 36/9 |
| 3,560,347 | 2/1971 | Knapp | 201/108 |
| 3,775,860 | 12/1973 | Barnes et al. | 34/1 |
| 3,845,270 | 10/1974 | Widugris, Jr. | 219/10.55 R |
| 3,931,682 | 1/1976 | Candor | 34/1 |
| 3,993,739 | 11/1976 | Vanderveen | 34/4 |
| 4,168,418 | 9/1979 | Bird | 219/10.55 A |
| 4,294,624 | 10/1981 | Veltman | 219/10.55 A X |
| 4,413,425 | 11/1983 | Candor | 34/1 |
| 4,466,198 | 8/1984 | Doll | 34/1 |

OTHER PUBLICATIONS

Rush et al., "Criterion for Selective Microwave Heating of Sulphur in Coal" (Institute of Gas Technology, Chicago, Ill.-May 10, 1982) Fuel, 1983, vol. 62, Apr., pp. 459-461.

Mujumdar, "Advances in Drying", vol. 2, Chapter 2, Hemisphere Publishing Corporation, Jun. 1983, pp. 53-71.

Hamid, "Basic Principles of Microwave Power Heating" (18th IECEC-Aug. 21-26, 1983) pp. 2116-2122.

Kirk-Othmer, "Encyclopedia of Chemical Technology", pp. 576 & 585-586, Copyright 1971 by John Wiley & Sons.

Wyman, The Application of Electronic Sorting to Minerals, Beneficiation (Mines Branch Technical Bulletin TB 82).

Edmonds, Note on a New Optical Sorting System, Journal of the Institute of Fuel, May 1955, pp. 231-234.

Kortüm, Reflectance Spectroscopy, Principles, Methods, Applications, Springer-Verlag, New York, 1969.

Miller, Radio-Frequency Lumber Drying: Methods, Equipment & Costs, Canadian Forest Industries, Jun. 1966, pp. 53-57.

Klatt, Coal & Coal Products, ACS Symposium Series 205, American Chemical Society, 1982, pp. 268-279.

Hubble, Consider Microwave Drying, (Dow Chem.) Chemical Engineering, Oct. 4, 1982.

*Primary Examiner*—Philip H. Leung

*Attorney, Agent, or Firm*—William R. Sharp

[57] ABSTRACT

An apparatus and method for drying a solid material wherein the solid material is exposed to a radio frequency electromagnetic field such that water is expelled from the surface of the solid material as a liquid. The liquid water thus expelled is then collected.

10 Claims, 2 Drawing Figures

APPARATUS AND METHOD FOR DRYING SOLID MATERIALS

BACKGROUND OF THE INVENTION

In one aspect, this invention relates to an apparatus for drying solid materials which contain water. In another aspect, the invention relates to a method of drying solid materials.

The invention is particularly applicable to the drying of lignite, although it should be understood that the invention may be equally suitable for the drying of other coals, rubber products, ceramic materials, wood, or any other moisture laden material from which water removal is desirable. Lignite is a low ranking subbituminous coal which has a relatively low heating value of typically about 7,000 B.T.U. per pound, about half of higher ranking coals. This low heating value is primarily attributable to lignite's high moisture content, which ranges from 15% to 60% by weight. Thus, it is desirable to remove water from lignite to increase its heating value accordingly. Another reason for drying lignite is that very moist lignite cannot properly be gasified in a coal gasifier. As is well known, coal is frequently fed into a coal gasifier, such as a Lurgi reactor, wherein the coal is contacted with steam and oxygen to produce a useable fuel gas.

Past methods of drying lignite, typically involving subjecting the lignite to hot gases, cause considerable decrepitation of lignite lumps. Such decrepitation is thought to be caused primarily by rapid vaporization of water from the surface of the lignite, which is accompanied by closing of pore openings, shrinkage, etc. Decrepitation of lignite lumps is particularly undesirable since resulting very fine lignite particles can plug a coal gasifier so as to reduce the gasifier efficiency or render it inoperable. In addition, fine lignite particles or dust produced by prior drying techniques present a considerable fire and explosion hazard.

SUMMARY OF THE INVENTION

It is, therefore, an object of the present invention to provide an apparatus and method of drying solid materials.

It is also an object of the invention to provide an apparatus and method of drying solid materials wherein decrepitation of such materials is minimized.

The above objects are realized in an apparatus and method for drying a solid material wherein the solid material is exposed to a radio frequency electromagnetic field such that water is expelled from the surface of the solid material as a liquid. The liquid water thus expelled is then collected.

According to a preferred embodiment particularly suitable for drying large volumes of lignite, means is provided to automatically maintain a condition wherein water is given off as a liquid. Thus, the lignite surfaces are kept moist to avoid decrepitation accordingly. In the particular embodiment illustrated and described, a photometric sensor is provided to detect and measure reflectance characteristics of lignite being dried. A controller acts to control the intensity of the radiation in response to the measured reflectance characteristics so as to keep the lignite surfaces moist. Reflectance can be used in this regard since a solid material typically darkens in response to surface moisture.

DETAILED DESCRIPTION OF THE DRAWINGS

A preferred embodiment of the present invention will now be described which effectively dries solid materials with a minimum of disintegration. Although, this embodiment will be described in terms of lignite drying, it should be understood that the invention could be applied to the drying of many other materials.

Figure 1:
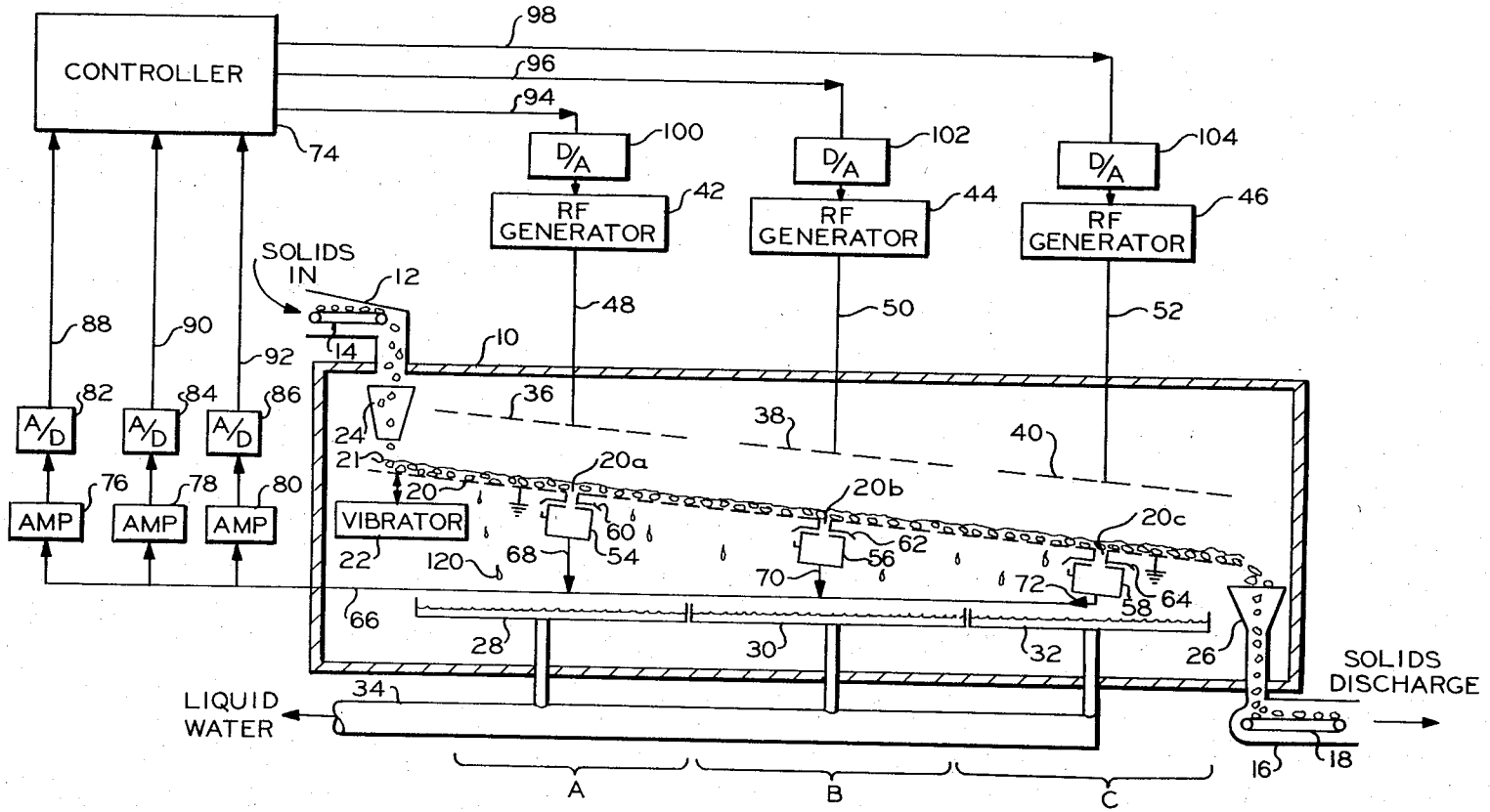
FIG. 1 is a schematic representation of one embodiment of the present invention which includes several photometric sensors.

Referring to FIG. 1, the illustrated apparatus includes a shell 10 which is preferably of metallic construction due to the generation of high power RF electromagnetic waves therein, the source of which will be described below. A metal is most preferably used for shell 10 since metals are generally good reflectors of RF waves. Thus, shell 10 acts as a shielding device to contain RF waves within its walls. Shell 10 may be of a solid construction as shown, particularly where a high pressure is desired in the shell, or the shell may be wire mesh or screen having properly dimensioned holes to prevent escape of RF waves. An inlet member 12 is provided for receiving lignite lumps or fragments. As shown, inlet member 12 is a generally tubular member suitably mounted to shell 10 as to be in communication with the interior of the shell. A conveyor belt 14 onto which lignite may be loaded is disposed within the inlet member 12. Most preferably, inlet member 12 is of a solid or mesh-like metallic construction. The illustrated right angle bend in inlet member 12 tends to reflect RF waves transmitted into the member back into shell 10, and thus assists in minimizing escape of RF waves from the apparatus. Also in this regard, the lower portion of inlet member 12 can be sized such that its diameter is less than $\lambda/4$ where $\lambda$ is wavelength, and thus below cutoff. An inlet member kept to such dimensions will not transmit the RF waves therethrough. However, for high frequencies in the microwave region of the spectrum, incorporation of such a feature would not be possible due to an impractically small member diameter. An outlet member 16 having a conveyor 18 therein is also provided at the opposite end of shell 10. Outlet member 16 is substantially similar in construction to inlet member 12.

In regard to the RF shielding aspects of the illustrated apparatus, it is important to provide adequate shielding measures such as those described above since high power RF waves, particularly at higher frequencies, can be extremely harmful to humans close by. As to microwaves, according to the American Conference of Governmental and Industrial Hygienists, continuous exposures should be kept below 10 $mW/cm^2$.

An inclined chute conveyor 20 is disposed within shell 10. Conveyor 20 preferably comprises a metallic wire mesh which serves to support a bed 21 of lignite fragments thereon. Conveyor 20 also functions as a grounded electrode for the RF field generation system, the remainder of which will be described hereinafter. It should be understood, however, that an electrode separate from the conveyor could be employed if desired. For lignite drying, the conveyor belt is preferably about 100 to about 200 feet in length, and from about 5 to about 10 feet in width. Conveyor 20 also includes viewing windows 20*a–c*, each of which comprises a transparent material such as plexiglass suitable for transmitting light therethrough to sensors, hereinafter described. A vibrator 22 is operably connected to chute conveyor 20 for vibrating the conveyor. The apparatus also includes hopper 24, chute 26, and collection pans 28, 30, and 32 disposed below conveyor 20. Some distributor means associated with hopper 24, such as an oscillator distributor (not shown), could be provided to distribute lignite lumps evenly over conveyor 20. A conduit system 34 is provided for withdrawing liquid from the collection pans.

Three separate electrodes 36, 38, and 40 are positioned within shell 10 directly above conveyor 20, the electrodes being spaced from one another such that each electrode lies above a different portion of conveyor 20. Thus, the apparatus can be thought of as being divided into three regions A, B, and C corresponding to electrodes 36, 38, and 40 respectively. Although three electrodes are shown in the illustrated embodiment, any number could be used within certain practical limits. Preferably, each electrode is about the same width as conveyor 20. A mesh-like metallic screen wire most suitably serves as each electrode, although a solid metal plate could also be employed. The mesh construction is preferred, however, because of its lower weight and consequent ease of mounting and/or removal from shell 10.

RF (radio frequency) generators 42, 44, and 46 are provided for supplying RF energy to electrodes 36, 38, and 40 respectively via transmission lines 48, 50, and 52. Each RF generator may be any suitable source of electromagnetic energy in the radio frequency range (those frequencies below the infrared range) of the electromagnetic spectrum. The type of RF generator employed depends upon the frequency selected for operation. For example, if operation in the microwave region is desired, the RF generators may be any of the commercially available microwave generators, such as the magnetron, klystron etc. The frequency of operation selected is dictated to a large degree by the law. The Federal Communication Commission has designated certain radio frequency bands for industrial, scientific, and medical applications in what is known as the U.S. Frequency Allocation. If microwaves are used, for example, the frequencies of 915 and 2450 mHz could be employed. It is emphasized, however, that any radio frequencies could be used within legal limits, the selection of which depends upon a variety of factors which include properties of the material being dried, bed depth, the air space between the electrodes and the bed, etc. Generally speaking, it can be said that deeper bed depths are associated with lower frequencies. The frequency selected should be one that will allow adequate penetration of RF waves into the bed. Furthermore, it should be noted that operating efficiency is generally poorer for high frequencies, such as microwaves, as compared with lower frequencies.

The screen electrodes shown are most suited for use with frequencies below about 30 mHz. Transmission lines 48, 50, and 52 may be coaxial cables, wherein a portion of each cable is connected to a screen electrode, the other portion being connected to the grounded electrode which in the illustrated embodiment is conveyor 20. If a higher frequency is employed, such as in the microwave region of the spectrum, the transmission lines would preferably comprise hollow wave guides. The screen electrodes would be replaced by horns coupled to the wave guides.

Since the lignite passing under the screen electrodes is of varying properties, the impedance presented to each RF generator will also vary. To correct for this, it may be desirable to provide matching networks (not shown) to intercept RF signals being transmitted from the generator to the screen electrodes. Such matching networks would help to insure that the impedance presented to each RF generator is constant. Any RF generator typically has an impedance range within which operation should be maintained to avoid damage to various components.

Photometric sensors 54, 56, and 58 are positioned below conveyor windows 20*a*, 20*b*, and 20*c* respectively such that each sensor is situated approximately at the center of each of regions A, B, and C. Each sensor is designed in this particular embodiment to detect diffuse reflectance of the lignite fragments. The term diffuse reflectance is later discussed in detail. Sensor details will be discussed with reference to FIG. 2. Protective shields 60, 62, and 64 are associated with sensors 54, 56, and 58 respectively, wherein each shield functions to receive any liquid falling from bed 21 and through conveyor 20. The liquid so received will flow from the edges of each shield to be collected in the collection pans. As shown, each shield has an aperture positioned directly beneath a corresponding window.

As used herein, reflectance of a body is defined as the ratio of reflected intensity to the incident intensity. Total reflectance is made up of two components: specular reflectance and diffuse reflectance. In specular reflection, a narrow or pencil beam of light is reflected in one direction only. This type of reflection occurs from smooth surfaces whose irregularities are small compared with the wave length of the reflected wave. In diffuse reflection, a narrow beam of light incident on a body is reflected in all directions. This type of reflection occurs wherever the roughness of the reflecting body has "dimensions" large compared with the wavelength of the reflected wave.

Sensors 54, 56, and 58 produce electrical signals proportional to the diffuse reflectance of lignite fragments above their respective viewing windows. Diffuse reflectance of the lignite is generally related to the surface moisture content of the lignite. It can be visually observed that a porous material such as lignite becomes darker with increasing surface moisture, but at the same time becomes glossier. In terms of reflectance components, this means that with increasing surface moisture, diffuse reflectance will generally decrease whereas specular reflectance (or "gloss") will increase. For a discussion of this phenomenon, reference is made to pages 234–236 of *Reflectance Spectroscopy* by Gustav Kortüm, Springer-Verlag, N.Y., 1969, such disclosure being herein incorporated by reference, and also to articles by Wyman and Newman et al. cited hereafter in reference to FIG. 2.

Thus, as the surface moisture of the lignite changes, the sensor output signal changes accordingly.

These signals are coupled into feeder line 66 via lines 68, 70, and 72. It should be understood that wiring running from the sensors should be suitably protected from liquid dripping from the lignite bed. Such protective features might include plastic tubing, for example, for receiving wiring therethrough. The sensor output signals are coupled into a controller 74 through amplifiers 76, 78, and 80, and A/D (analog to digital) converters 82, 84, and 86. The controller receives digital sensor signals as input signals via lines 88, 90, and 92, corresponding to sensors 54, 56, and 58 respectively.

Controller 74 is programmed to process the above-mentioned input signals, and may be a digital computer or a commercially available analog or digital controller well known in the process control art. The controller shown is digital, and may utilize various modes of control such as proportional, proportional-integral, proportional-derivative, or proportional-integral derivative. A proportional-integral control mode is preferred for use in the present invention, but any controller capable of comparing an input signal and a set point so as to produce an output signal representative of the comparison is within the scope of the present invention.

In the illustrated embodiment, the set point is a predetermined diffuse reflectance value. The predetermined set point selected should generally correspond to a desired lignite surface moisture content. It should be kept in mind in choosing a set point value that diffuse reflectance of lumps in the bottom of the bed is being detected, and that these bottom lumps will be more moist (and have lower diffuse reflectance values) than lumps closer to the bed upper surface. An output control signal of controller 74 in the proportional-integral mode is a function of the difference between the diffuse reflectance value represented by an input signal and the set point, wherein this difference is usually denoted as the error E. An output signal in the proportional-integral mode will have a proportional term and an integral term as is well known to those skilled in the art. Reference is made to U.S. Pat. No. 4,367,121 for a more detailed discussion of the above control modes. Each output signal is coupled into one of lines 94, 96, or 98, and is scaled to represent a desired change in power output of its corresponding RF generator. Thus, if the diffuse reflectance value represented by a particular input signal is above the set point (or predetermined reflectance) value, this indicates the lignite is too dry, and an error or E value exists. An output signal is produced in response to this E value which is representative of a desired decrease in RF generator power output. Such a decrease in power should cause more water to be expelled from the lignite as liquid, as will be explained in more detail below, and a consequent increase in surface moisture content and decrease of diffuse reflectance to the desired set point value. Likewise, if the diffuse reflectance value is below the set point value, controller 74 produces an output signal representative of an increase in RF generator power.

Output signals are fed through lines 94, 96, and 98, and are provided as inputs to D/A (digital to analog) converters 100, 102, and 104 respectively. Each A/D converter converts its input signal to analog form, the resulting analog signal being provided as an input to a corresponding RF generator.

The RF generators in the illustrated embodiment are preferably of the type which have voltage controlled outputs. By way of example, such a voltage control feature may comprise a linear attenuator which attenuates a signal supplied to an amplifier in the generator in response to an incoming control signal. It should be understood, however, that the RF generators could be controlled by any other means adaptable to automatic operation, such as a motor controlled potentiometer.

Figure 2:
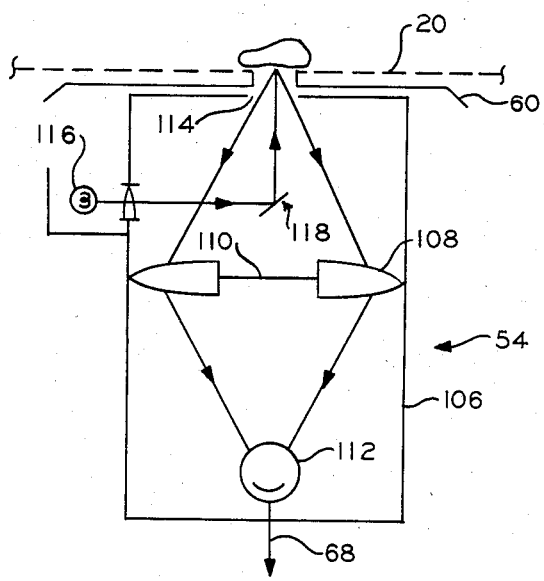
FIG. 2 is a schematic illustration of one sensor shown in FIG. 1.

Referring now to FIG. 2, a schematic illustration of photometric sensor 54 is shown which reveals internal details. Shield 60, a portion of conveyor 20, and a lignite fragment or lump is also shown. Sensors 56 and 58 are substantially similar to the illustrated sensor. The illustrated sensor is essentially a slightly modified version of the Newman and Whelan sensor which is shown and described in "The Application of Electronic Sorting to Minerals Beneficiation" by R. A. Wyman, Mines Branch (Canada Department of Energy) Technical Bulletin TB 82. Reference is also made to "Photometric Separation of Ores in Lump Form" by P. C. Newman and P. F. Whelan, *Recent Developments in Mineral Processing*, The Institute of Mining and Metallurgy, London, England, pp. 359–383 (1953), such disclosure being herein incorporated by reference. The illustrated sensor is simplified in that it is designed to detect diffuse reflectance only, whereas the Newman and Whelan sensor detects both specular reflectance and diffuse reflectance.

Sensor 54 includes a suitable housing 106 having a convex lens 108 mounted therein. As shown, the center of lens 108 has been removed and replaced with a light trap 110. A photomultiplier 112 is positioned at the far end of the housing so as to be generally aligned with an aperture 114 at the other end of the housing. A light source 116, such as a tungsten or xenon source, is positioned to direct a light beam onto a beam splitter mirror 118. The mirror reflects the beam through aperture 114 and the conveyor window such that the beam is incident on a fragment or lump as shown. Only one fragment is shown in the FIGURE for clarity of illustration. Vibration of the lignite lumps by vibrator 22 positions the lumps over the viewing window so that the chances of a reasonably flat reflecting surface being suitably oriented for reflection are greatly enhanced. It is preferred that reasonably flat reflecting surfaces are presented to each viewing window to insure accurate sensor diffuse reflectance measurements. Light incident on the lignite lump surface is reflected thereby, the light being reflected specularly and diffusely. Specularly reflected light is reflected in a direction generally opposite to the direction of the incident light. Thus, the specularly reflected light is intercepted by light trap 110, such that this reflection component is prevented from reaching photomultiplier 112. Diffusely reflected light is scattered in all directions, a portion of this reflection component being received by lens 108 and focused onto photomultiplier 112 accordingly. The output of photomultiplier 112 is generally proportional to the intensity of the received diffusely reflected light. Since the intensity of the incident light is relatively constant, the photomultiplier output is also generally proportional to the diffuse reflectance of the lignite lump above the viewing window.

Although the sensors in the illustrated embodiment detect diffuse reflectance, it should be understood that the sensor could be modified to detect only specular reflectance, or both specular reflectance and diffuse reflectance. Furthermore, any photometric sensor could be employed which can successfully separate the reflectance components and detect one or both components. One such alternate sensor utilizes a rotating polaroid disk to detect specular reflectance. Reference may be made to "Note on a New Optical Sorting System" by L. E. Edmonds, *Journal of the Institute of Fuel*, May, 1955, for a description of this sensor.

In operation, lignite lumps or fragments are dried with the illustrated apparatus as follows. Mined lignite is first crushed and then screened to remove fines, yielding lumps ranging in diameter from about ¼ inch to about 6 inches. The lumps are then loaded onto conveyor 14, which deposits the fragments into hopper 24. Hopper 24 distributes lignite lumps onto conveyor 20 to form bed 21. Vibrator 22 shakes the lumps in the direction of the conveyor slope, such that the lumps move slowly down conveyor 20. The velocity of such movement can be regulated, for example, by changing the slope of conveyor 20. It is also emphasized that vibration of conveyor 20 should be kept to a minimum to aid in preventing lump decrepitation.

An RF field is generated by means of the various electrodes and RF energy supplied thereto. The RF waves thus generated penetrate the lignite bed, and are absorbed by water, a polar solvent, causing molecular vibrations and thus heating of the water in the lignite. It is emphasized that the water contained in the lignite lumps, and not the lignite itself, is heated by the RF waves, such that less thermal energy is required than in conventional heating techniques. Upon start up of the apparatus, a predetermined base level RF power output is provided by each of the generators such that a corresponding base level RF field intensity is generated to which the lignite is exposed. Controller 74 may be suitably programmed to provide output signals necessary to initially achieve this base level power. This base level power is assumed to be sufficiently high to drive water from the lignite in some form, either liquid or vapor.

As noted above, if a sensor in a particular region detects a diffuse reflectance value which does not correspond to the set point value, controller 74 produces a signal which raises or lowers the power output of an RF generator, such that the field intensity is raised or lowered accordingly to achieve the desired diffuse reflectance and corresponding surface moisture content. Thus, controller 74 and the sensors act to regulate the field so as to maintain a condition wherein a substantial portion of water expelled by the lignite is expelled as a liquid, such that a layer of liquid water is maintained on the lignite surfaces. One possible explanation for this phenomenon of liquid water expulsion is that under carefully controlled RF field conditions, the heat generated within the lignite creates a vapor drive to move liquid water to the surface. Excessively high RF field intensities will cause vaporization of water at the surface of the lumps and also in the lumps. Preferably, the surface temperature of the lignite is kept below about 105° F. Water expelled as discussed above drips through the conveyor as schematically shown at 120 in FIG. 1 and is collected in pans 28, 30, and 32. The water thus collected is withdrawn from the pans via conduit system 34 for use in another process or for disposal as appropriate. Dried lignite falls from conveyor 20 into hopper 26 so as to be deposited onto conveyor 18. The dried lignite is removed and passed on to further processing such as gasification. In the case of Yantis, Tx., lignite, which has a moisture content of 35%, the illustrated embodiment can be expected to reduce the moisture content by 7% to result in 28% moisture content. This amounts to a 20% reduction in moisture content.

As to environmental conditions within shell 10, certain conditions may serve to enhance the liquid water expulsion effect discussed above. For example, maintaining a high humidity can be expected to force separation of the expelled liquid from the lignite. Most preferably, a saturated atmosphere is maintained within the shell. Additionally, although the illustrated embodiment employs atmospheric pressure, a higher pressure could be utilized to further enhance the drying effect.

It should be understood that factors other than field intensity affect heating of the lignite. Frequency, lump size, and properties of the lignite such as its dielectric loss factor also affect the power absorbed and thus the consequent heating effect. Since one is restricted to the use of certain frequencies by the law as noted above, field intensity is most conveniently regulated to maintain a condition wherein liquid water is expelled by the lignite.

By expelling water from the lignite as a liquid, the wetness of lump surfaces helps minimize closing of pore openings and resulting decrepitation. As noted above, minimization of decrepitation of lignite lumps in drying maximizes the efficiency of subsequent gasification, and also assists in minimizing fire and explosion hazards which can arise from excessive dust. In addition, drying according to the present invention is less expensive than prior methods, since expulsion of water as a liquid requires less thermal energy than vaporization.

It is emphasized that many modifications of the illustrated embodiment are possible. For example, a photometric sensor could be utilized which includes a laser scanner. The scanner could be conveniently positioned above the lignite bed. Scaning sensors commonly employed in ore sorters could be adapted to detect diffuse and/or specular reflectance. Moreover, any sensor suitable to detect surface moisture could be employed. It is envisioned that radiometric, conductivity, and ultraviolet fluorescence sensors commonly used in ore sorting could be adapted for use with the present invention. Furthermore, manual control of the RF field intensity is within the scope of the present invention. In such an embodiment, an operator could simply visually observe whether the surface of the lignite is moist or dry and manually control an RF generator accordingly.

An example will now be described wherein several tests were run with Yantis lignite utilizing a laboratory microwave oven. The oven used was a Raytheon, Model QMP, Serial 0011 producing 2450±50 MHz. It is a steady heat oven with 18 750-watt magnetrons with an interval time control. The number of magnetrons on at any one time can be adjusted. The inside of the oven is about 3'×3'×6'. Three runs were made. The first and second runs were made with single lump samples approximately 3½ inches in diameter, and the third run was made with a lump plus a number of smaller ½" lumps. In the first run, only one magnetron was used corresponding to a power of 750 watts. The second and third runs employed two magnetrons corresponding to a power of 1500 watts. Lump samples were placed on a sample dish inside the oven, and periodically removed from the oven for weighing. The following tables show surface temperature and weights of the samples after different times in the oven.

| | Run 1 | |
|---|---|---|
| Time (minutes) | Surface Temp (°F.) | Weight (Grams) |
| Initial | 77.0 | 413.7 |
| 5 | 110.0 | 411.1 |
| 10 | 130.0 | 403.5 |
| 15 | 140.0 | 389.5 |
| 20 | 150.0 | 373.3 |
| 25 | 160.0 | 355.8 |
| 30 | 160.0 | 338.7 |

Surface water appeared in Run 1 at 3 minutes 30 seconds. Copious water exuded at 4 minutes, and water continued to exude at 7 minutes. One slight crack appeared at 10 minutes, and a number of additional small cracks appeared at 15 mins. After the 15 minutes interval, water was still in the sample dish. At 22 minutes 35 seconds, a chunk of lignite was observed to drop off the lump. At 30 minutes, water was still observed in the sample dish, and multiple cracks were observed.

| Run 2 | | |
|---|---|---|
| Time (minutes) | Surface Temp (°F.) | Weight (Grams) |
| Initial | 77.0 | 360.35 |
| 5 | 160.0 | 349.05 |
| 10 | 170.0 | 313.75 |
| 15 | 170.0 | 281.65 |

In Run 2, surface water appeared at 1 minute. Steam was observed at 2 minutes. Water was in the sample dish at 2 minutes, but less than that observed in Run 1. The lump was in good condition at 5 minutes, but a crack appeared at 7 minutes. Water ceased to exude from the lump at 9 minutes.

| Run 3 | | |
|---|---|---|
| Time (minutes) | Surface Temp (°F.) | Weight (Grams) |
| Initial | 77.0 | 343.81 |
| 5 | 185.0 | 299.31 |
| 10 | 180.0 | 263.11 |

In Run 3, water was observed to exude at 1 minute 30 seconds. The larger lump appeared to be slower in expelling water. The sample steamed at 3 minutes. Cracks appeared at 4 minutes 35 seconds, and a bigger crack at 5 minutes in a smaller lump. Also at 5 minutes, water was in the sample dish. Cracks were observed to worsen at 6 minutes. At 10 minutes, it was noted that the ½-inch lumps dried without cracking.

In summary, liquid water was expelled from the lignite samples in all runs in sufficient quantity for water to remain in the sample dish when the run was complete. At the end of each run the lignite appeared dry and the larger lumps had decrepitated to a significant extent.

The first run appeared to expel the most liquid water. The sample had a clean break on one side rather than a rough surface. Expulsion of water was more easily observed from the clean break. It was larger than the other lumps and more time was available for the expelling phase at low temperatures.

Most importantly, expulsion of liquid water from the lignite samples caused a minimum of decrepitation. In the assorted-size sample, the smaller ½" lumps dried without any apparent decrepitation. Expulsion of water was more easily observed from the clean break.

What is claimed is:

1. An apparatus for drying a solid material containing water comprising:

generator means for generating a radio frequency electromagnetic field in the vicinity of the solid material;

detection means for detecting the amount of moisture on the surface of the solid material, the surface moisture so detected being denoted as the surface moisture content;

control means for controlling the field generated by said generator means in response to the detected surface moisture content so as to maintain a condition wherein water is expelled from the material substantially as a liquid;

means for collecting the liquid water expelled by the solid material.

2. An apparatus as recited in claim 1, wherein said control means controls said generator means such that the field generated thereby causes the solid material to have a predetermined surface moisture content.

3. An apparatus as recited in claim 2, wherein said control means controls the intensity of the field.

4. An apparatus as recited in claim 1, wherein said detection means detects reflectance characteristics of the solid material, certain predetermined reflectance characteristics corresponding to the predetermined surface moisture content.

5. A method of drying a solid material containing water comprising:

generating a radio frequency electromagnetic field in the vicinity of the solid material;

detecting the amount of moisture on the surface of the solid material, the surface moisture so detected being denoted as the surface moisture content;

controlling the field in response to said surface moisture detection so as to maintain a condition wherein water is expelled from the solid material substantially as a liquid, and collecting the liquid water expelled by the solid material.

6. A method as recited in claim 5, wherein in said controlling step the field is controlled in response to said surface moisture detection so as to maintain a predetermined surface moisture content.

7. A method as recited in claim 6, wherein the field is controlled by controlling the intensity of the field.

8. A method as recited in claim 5, wherein in said detecting step, certain predetermined reflectance characteristics are detected which correspond to the predetermined surface moisture content.

9. A method as recited in claim 8, wherein the solid material is lignite.

10. A method as recited in claim 9, wherein the lignite is dried in a saturated atmosphere.

* * * * *